US008272101B2

(12) United States Patent
Wagner et al.

(10) Patent No.: US 8,272,101 B2
(45) Date of Patent: Sep. 25, 2012

(54) DOOR HINGE AND DOOR ARRANGEMENT

(75) Inventors: Konstantin Wagner, Laupheim (DE); Sergej Moiseenko, Ulm (DE); Sebastian Fritzsche, Luckau (DE)

(73) Assignee: Airbus Operations GmbH, Hamburg (DE)

( * ) Notice: Subject to any disclaimer, the term of this patent is extended or adjusted under 35 U.S.C. 154(b) by 235 days.

(21) Appl. No.: 12/598,393

(22) PCT Filed: Apr. 28, 2008

(86) PCT No.: PCT/EP2008/003435

§ 371 (c)(1),
(2), (4) Date: Mar. 29, 2010

(87) PCT Pub. No.: WO2008/131955

PCT Pub. Date: Nov. 6, 2008

(65) Prior Publication Data

US 2010/0213317 A1 Aug. 26, 2010

Related U.S. Application Data

(60) Provisional application No. 60/914,780, filed on Apr. 30, 2007.

(30) Foreign Application Priority Data

Apr. 30, 2007 (DE) ..... 10 2007 020 395

(51) Int. Cl.
*E05D 15/50* (2006.01)

(52) U.S. Cl. ..... 16/231; 16/365

(58) Field of Classification Search ..... 16/230–232, 16/DIG. 23, 386, 387, 258, 261, 262, 366, 16/371, 365; 49/193, 192, 381, 395; 312/324, 312/325, 326, 328
See application file for complete search history.

(56) References Cited

U.S. PATENT DOCUMENTS 177,708 A * 5/1876 Gilfillan ..... 16/265
843,661 A * 2/1907 Brice ..... 16/365
(Continued)

FOREIGN PATENT DOCUMENTS

DE 44 17 383 A1 11/1995
(Continued)

OTHER PUBLICATIONS

International Search Report, PCT/EP2008/003435, Aug. 27, 2008.
(Continued)

*Primary Examiner* — Chuck Y. Mah
(74) *Attorney, Agent, or Firm* — Krieg DeVault LLP

(57) ABSTRACT

A door hinge comprises a first hinge element fastenable to a door frame and a second hinge element fastenable to a door leaf and includes first and second hinge blade. A first pivot axis is connected, when the door hinge is in a first operating condition, to first and second hinge elements such that the second hinge blade is pivotable relative to the first hinge element, in a first pivot direction, for unblocking a door aperture. The first pivot axis is decoupled from the first or the second hinge element when the door hinge is in a second operating condition. A second pivot axis is connected to the first and second hinge elements such that said first and second hinge elements are pivotable relative to one another, in a second pivot direction which is opposed to the first pivot direction, for unblocking the door aperture.

19 Claims, 7 Drawing Sheets

U.S. PATENT DOCUMENTS

| | | | | | |
|---|---|---|---|---|---|
| 863,128 | A | * | 8/1907 | Aebi | 16/243 |
| 1,021,885 | A | * | 4/1912 | Peterson | 16/262 |
| 1,144,404 | A | * | 6/1915 | Williams | 16/260 |
| 1,185,157 | A | * | 5/1916 | Yates | 16/366 |
| 1,375,212 | A | * | 4/1921 | Crone | 16/366 |
| 1,660,657 | A | * | 2/1928 | Regan | 16/387 |
| 1,904,110 | A | * | 4/1933 | Willmann | 49/371 |
| 1,925,798 | A | * | 9/1933 | Epton et al. | 16/232 |
| 2,186,789 | A | * | 1/1940 | Rosenberg | 16/229 |
| 2,205,484 | A | * | 6/1940 | Lindsay | 16/350 |
| 3,949,445 | A | * | 4/1976 | Stevens | 16/262 |
| 4,482,023 | A | * | 11/1984 | Dziedzic et al. | 180/89.17 |
| 5,282,293 | A | * | 2/1994 | Pedoeem | 16/342 |

FOREIGN PATENT DOCUMENTS

| | | | |
|---|---|---|---|
| NL | 1 025 563 | C2 | 8/2005 |
| NL | 1 026 237 | C1 | 11/2005 |

OTHER PUBLICATIONS

English Summary of DE 44 17 383 A1, Nov. 23, 1995, Ed. Scharwachter GmbH.

* cited by examiner

DOOR HINGE AND DOOR ARRANGEMENT

CROSS REFERECE TO RELATED APPLICATIONS

The present application is a §371 national stage patent application of PCT/EP2008/003435, filed Apr. 28, 2008, which claims priority from German Patent Application No. 10 2007 020 395.2, filed Apr. 30, 2007 and claims the benefit of U.S. Provisional Patent Application Ser. No. 60/914,780, filed Apr. 30, 2007, each of which is incorporated herein by reference.

FIELD OF THE INVENTION

The invention relates to a door hinge which is suitable, in particular, for fitting a door within a passenger cabin of a commercial aircraft. The invention also relates to a door arrangement equipped with a hinge of this kind.

BACKGROUND

Because of the environmental conditions on board an aircraft, and also because of the safety regulations that apply in aircraft manufacture, particular requirements are imposed upon the way in which a door between two separated-off areas of an aircraft cabin functions. For example, it must be possible, for safety reasons, to open a door of this kind completely, i.e. with an angle of opening of about 180°. In addition to this, it is necessary to ensure that the door can be opened, even in the event of a decompression, which leads to the building-up of a differential pressure that acts on the leaf of the door, within the aircraft cabin which is maintained at elevated pressure during flight.

SUMMARY

The underlying object of the invention is to make available a door hinge of robust construction which is suitable, in particular, for fitting a door within a passenger cabin of a commercial aircraft, and which permits the opening of the door with an angle of opening of about 180° when said door is being operated normally, and additionally ensures that said door can be reliably opened, even in the event of a decompression within the aircraft cabin. In addition to this, the underlying object of the invention is to make available a door arrangement equipped with a hinge of this kind.

These objects are achieved by means of a door hinge having the features indicated in patent claim 1, and also by means of a door arrangement having the features indicated in patent claim 13.

The door hinge according to the invention comprises a first hinge element which is fastenable to a door frame. A second hinge element of the door hinge according to the invention is fastenable to a door leaf and comprises a first hinge blade and also a second hinge blade. The second hinge blade of the second hinge element may, for example, be provided with a bore or a plurality of bores, so that said second hinge blade, and thereby the second hinge element, can be fastened to a front side of the door leaf with the aid of suitable fastening devices, such as screws or rivets. When the door hinge is in a first operating condition, a first pivot axis is connected to the first and second hinge elements in such a way that the second hinge blade of the second hinge element is pivotable about said first pivot axis, relative to the first hinge element and preferably also relative to the first hinge blade of said first hinge element, in a first pivot direction, for example in the clockwise direction, for the purpose of unblocking a door aperture which is bounded by the door frame.

When the door hinge according to the invention is in a second operating condition, on the other hand, the first pivot axis is decoupled from the first or the second hinge element. A second pivot axis is connected to the first and second hinge elements in such a way that, when the door hinge is in the second operating condition, said first and second hinge elements are pivotable about said second pivot axis, relative to one another, in a second pivot direction which is opposed to the first pivot direction, i.e. in the anticlockwise direction for example, for the purpose of unblocking the door aperture which is bounded by the door frame. In other words, when the door hinge according to the invention is in the second operating condition, it is not merely the second hinge blade of the second hinge element which is pivotable relative to the first hinge element, but the entire second hinge element.

When the door hinge according to the invention is in the first operating condition, which corresponds to a normal operating condition of the door hinge, a door leaf which is fastened to the second hinge element, i.e. to the second hinge blade of the second hinge element, is pivotable about the first pivot axis, relative to the door frame, by about 180° in the first pivot direction in order to completely unblock the door aperture which is bounded by the door frame. When the door hinge according to the invention is in the second operating condition, on the other hand, the door leaf fastened to the second hinge element is pivotable about the second pivot axis, relative to the door frame, in the second pivot direction which is opposed to the first pivot direction. The door hinge according to the invention thus makes it possible to pivot the door leaf, relative to the door frame, in two mutually opposed pivot directions, depending upon the operating condition of said door hinge.

When the door hinge is used for fitting a door within a passenger cabin of a commercial aircraft, the configuring of the door hinge in accordance with the invention ensures that the door aperture bounded by the door frame can be unblocked by pivoting the door leaf in the second pivot direction, even if a decompression within the aircraft cabin, which is maintained at elevated pressure during flight, leads to the building-up of a differential pressure which acts on said door leaf and prevents the pivoting of the latter in the first pivot direction. The door hinge according to the invention is therefore particularly well suited to use on board an aircraft, for example for fitting a door which divides a smoking area from a non-smoking area of the aircraft cabin.

The first hinge element of the door hinge according to the invention preferably comprises, in a manner similar to the second hinge element, a first and a second hinge blade. The first hinge blade of the first hinge element preferably extends substantially perpendicularly to the second hinge blade. While the first and second hinge blades of the second hinge element are pivotable about the first pivot axis, relative to one another, the first and second hinge blades of the first hinge element may be rigidly connected to one another. The first hinge element is preferably of one-piece design. However, it is also possible to design the first and second hinge blades of the first hinge element as separate components and to connect them to one another in order to form said first hinge element. In the condition in which it is mounted on a door frame, the first hinge blade of the first hinge element preferably extends along an inner side of said door frame. The second hinge blade of the first hinge element, on the other hand, preferably rests against a front side of the door frame when the first hinge element is in the condition in which it is mounted on said door frame.

A connecting device for connecting the first pivot axis to the first hinge element in a releasable manner may be provided on said first hinge element. Said connecting device may, for example, be fastened to the second hinge blade of the first hinge element by means of a suitable fastening device, such as a screw or a rivet for example. The first hinge element and also the connecting device are preferably constructed in such a way that a single fastening device can be used for fastening said connection device to said first hinge element and also for fastening said first hinge element to the door frame. For this purpose, the connecting device and the first hinge element, i.e. the second hinge blade of said first hinge element, are preferably provided with corresponding bores through which a fastening device can be passed in order to fasten the connecting device to the first hinge element and said first hinge element to the door frame.

The connecting device preferably comprises a leaf spring. In addition to this, said connecting device may also comprise a fastening section, which is provided with a bore, for fastening the connecting device to the second hinge blade of the first hinge element. The leaf spring of the connecting device may be shaped in a curved manner and adapted to engage round the first pivot axis when the door hinge according to the invention is in the first operating condition, and in this way connecting said first pivot axis to the first hinge element.

The connecting device is preferably designed in such a way that the connection between the first pivot axis and the first hinge element cannot be released manually, i.e. for example by pressing or striking against the door leaf fastened to the door frame by means of the door hinge according to the invention, but only when a predetermined differential pressure is acting upon the door leaf. When designing the connecting device, parameters such as, for example, the dimensions and weight of the door leaf, the dimensions of the door frame and the extent of that differential pressure acting upon the door leaf which is to be expected in the event of a decompression within the aircraft cabin, are to be taken into account. The geometry as well as the stiffness of the connecting device can, as required, be chosen in a manner specific to the application in dependence upon these parameters. It is possible to ensure, by designing the connecting device in a suitable manner, that the door aperture bounded by the door frame can be reliably unblocked by pivoting the door leaf in the second pivot direction, even if a differential pressure is acting upon said door leaf. At the same time, the risk of the connection between the first pivot axis and the first hinge element being released unintentionally is minimised.

In one preferred embodiment of the door hinge according to the invention, a first receiving apparatus for connecting the second pivot axis to the first hinge element is provided on said first hinge element. Said receiving apparatus may, for example, be formed by a bore which is constructed in a receiving section of the first hinge blade. In order to connect the second pivot axis to the first hinge element, said second pivot axis may then be inserted in a simple and convenient manner in the bore constructed in the receiving section of the first hinge blade of the first hinge element. The first receiving apparatus is preferably configured in such a way that the second pivot axis is received in said first receiving apparatus in an axially displaceable manner.

A holding device for connecting the first pivot axis to the second hinge element is preferably provided on said second hinge element. Said holding device is preferably of two-part construction in order to connect the first pivot axis to the first, and also to the second, hinge blade of the second hinge element. The holding device may, for example, comprise at least one holding arm which extends from the first hinge blade of the second hinge element and engages round the first pivot axis. In addition to this, the holding device preferably also comprises at least one receiving sheath which is attached to the second hinge blade of the second hinge element and in which the first pivot axis is received in order to connect said pivot axis to said second hinge blade of the second hinge element.

In that preferred embodiment of the door hinge according to the invention which has been described so far, the first pivot axis is connected to the first hinge element in a releasable manner, whereas there is a fixed connection between the first pivot axis and the second hinge element of the door hinge according to the invention. As an alternative to this, it, is of course also possible to fasten the first pivot axis to the second hinge element in a releasable manner, and to provide a fixed connection between the first hinge element and the first pivot axis.

In one particularly preferred embodiment of the door hinge according to the invention, the second hinge blade of the second hinge element is pretensioned, counter to the first pivot direction, by means of a spring which is constructed, for example, as a helical torsion spring. The pretensioning force exerted by the spring on the second hinge blade of the second hinge element guarantees that a door leaf connected to the second hinge blade of the second hinge element automatically occludes again the door aperture bounded by the door frame, if a manually applied force which holds the door leaf in its open position is no longer present. A door hinge equipped with a spring can be used in a particularly advantageous manner if it is desired to automatically return the door leaf to a position in which it occludes the door aperture bounded by the door frame. This is desirable, for example if the door hinge according to the invention is used in conjunction with a door arrangement which divides a smoking area from a non-smoking area within an aircraft cabin.

A second receiving apparatus for connecting the second pivot axis to the second hinge element may be provided on said second hinge element. Said second receiving apparatus may be designed, for example, in the form of a bore which is constructed in a receiving section of the first hinge blade of the second hinge element. For the purpose of connecting the second pivot axis to the second hinge element, said second pivot axis can then be inserted in a simple and convenient manner in the bore constructed in the receiving section of the first hinge blade of the second hinge element. The second receiving apparatus is preferably configured in such a way that the second pivot axis is received in said second receiving apparatus in an axially displaceable manner.

A spring-loaded unlocking lever for releasing the second pivot axis from the first or the second hinge element is preferably provided on said second pivot axis. Said spring-loaded unlocking lever preferably serves for releasing the second pivot axis from the first receiving apparatus which is constructed on the first hinge element. As an alternative to this, however, the spring-loaded unlocking lever may also serve for releasing the second pivot axis from the second receiving apparatus of the second hinge element. The essential point is that the spring-loaded unlocking lever releases the connection between the second pivot axis and the first or the second hinge element, so that it is possible, if necessary, i.e. in an emergency or for maintenance purposes, to separate the first hinge element from the second hinge element and to thereby separate the door leaf which is fastened to the said second hinge element from the door frame which is connected to the first hinge element.

The second receiving apparatus provided on the second hinge element preferably has a guide aperture for guiding the spring-loaded unlocking lever provided on the second pivot axis, when said spring-loaded unlocking lever is actuated. As an alternative to this, or in addition to this, the first receiving apparatus provided on the first hinge element may also have a guide aperture for guiding the unlocking lever provided on the second pivot axis, when said spring-loaded unlocking lever is actuated.

The guide aperture may have a displacement section and also a stop section which extends substantially perpendicularly to said displacement section. For the purpose of releasing the second pivot axis from the first or the second hinge element, the spring-loaded locking lever fastened to the second pivot axis is displaced, counter to the spring force, along the displacement section of the guide aperture, and the second pivot axis is thereby released from the first or second receiving apparatus. Said spring-loaded unlocking lever is then displaced along the stop section which extends substantially perpendicularly to the displacement section, and the second pivot axis is thereby held in its position in which it is released from the first or second receiving apparatus. If the connection between the first pivot axis and the first or the second hinge element is released, said first hinge element can then be separated from the second hinge element in a simple and convenient manner, and a door leaf which is connected to said second hinge element can be released from a door frame which is connected to the first hinge element.

A door arrangement according to the invention comprises a door frame, a door leaf and also an above described hinge element.

The door hinge according to the invention and the door arrangement according to the invention can be used in a particularly advantageous manner in an aircraft, in particular the passenger cabin of an aircraft.

BRIEF DESCRIPTION OF DRAWINGS

A preferred embodiment of a door hinge according to the invention will now be explained in greater detail with the aid of the appended diagrammatic drawings, in which.

DETAILED DESCRIPTION

Figure 1:
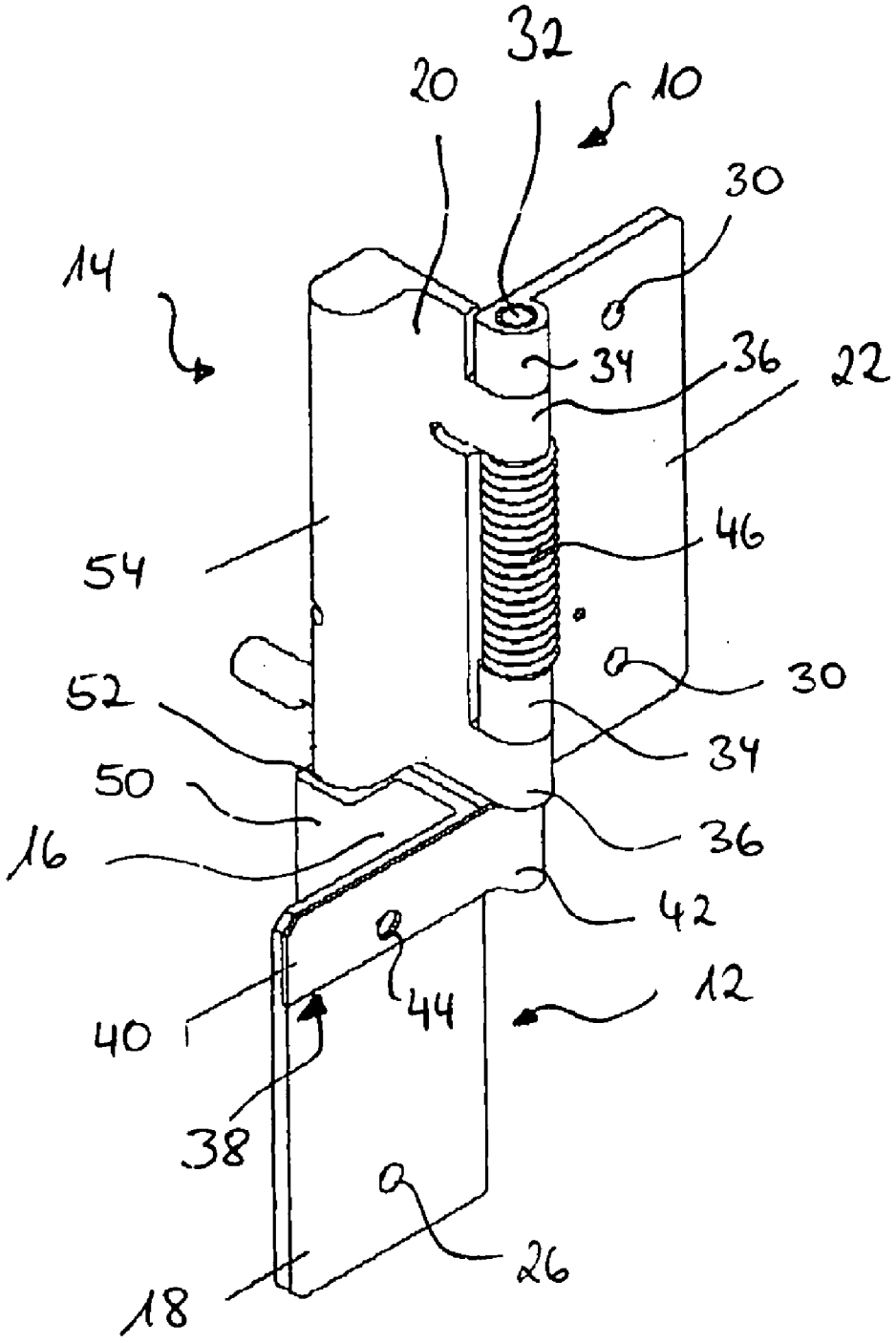
FIG. 1 shows a three-dimensional front view of a door hinge according to the invention in a first operating condition and in a closing position.

A door hinge 10 which is shown in FIGS. 1 to 9 comprises a first hinge element 12 and a second hinge element 14. Said first hinge element 12 comprises a first hinge blade 16 and a second hinge blade 18, said first and second hinge blades 16, 18 of the first hinge element 12 being of one-piece construction and extending substantially perpendicularly to one another. The second hinge element 14 comprises a first hinge blade 20 and also a second hinge blade 22 which is constructed separately from said first hinge blade 20.

Figure 3:
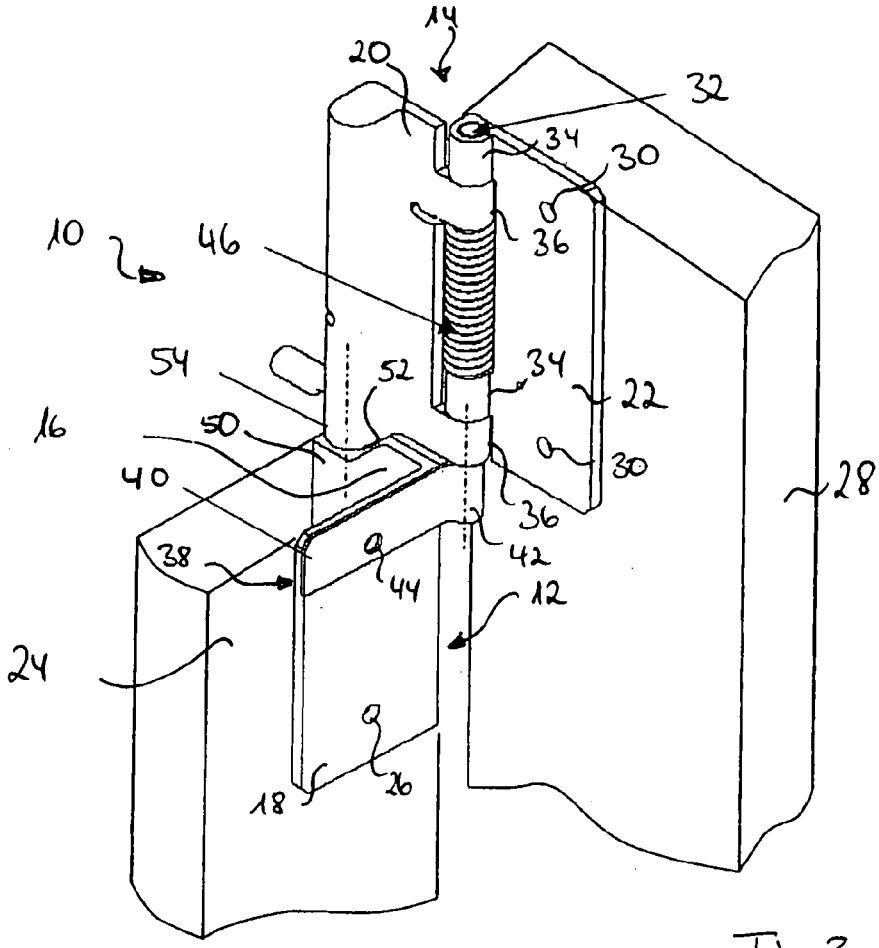
FIG. 3 shows a three-dimensional front view of the door hinge according to FIG. 1, in the condition in which it is connected to a door frame and also to a door leaf, and in a partially open position.
Figure 5:
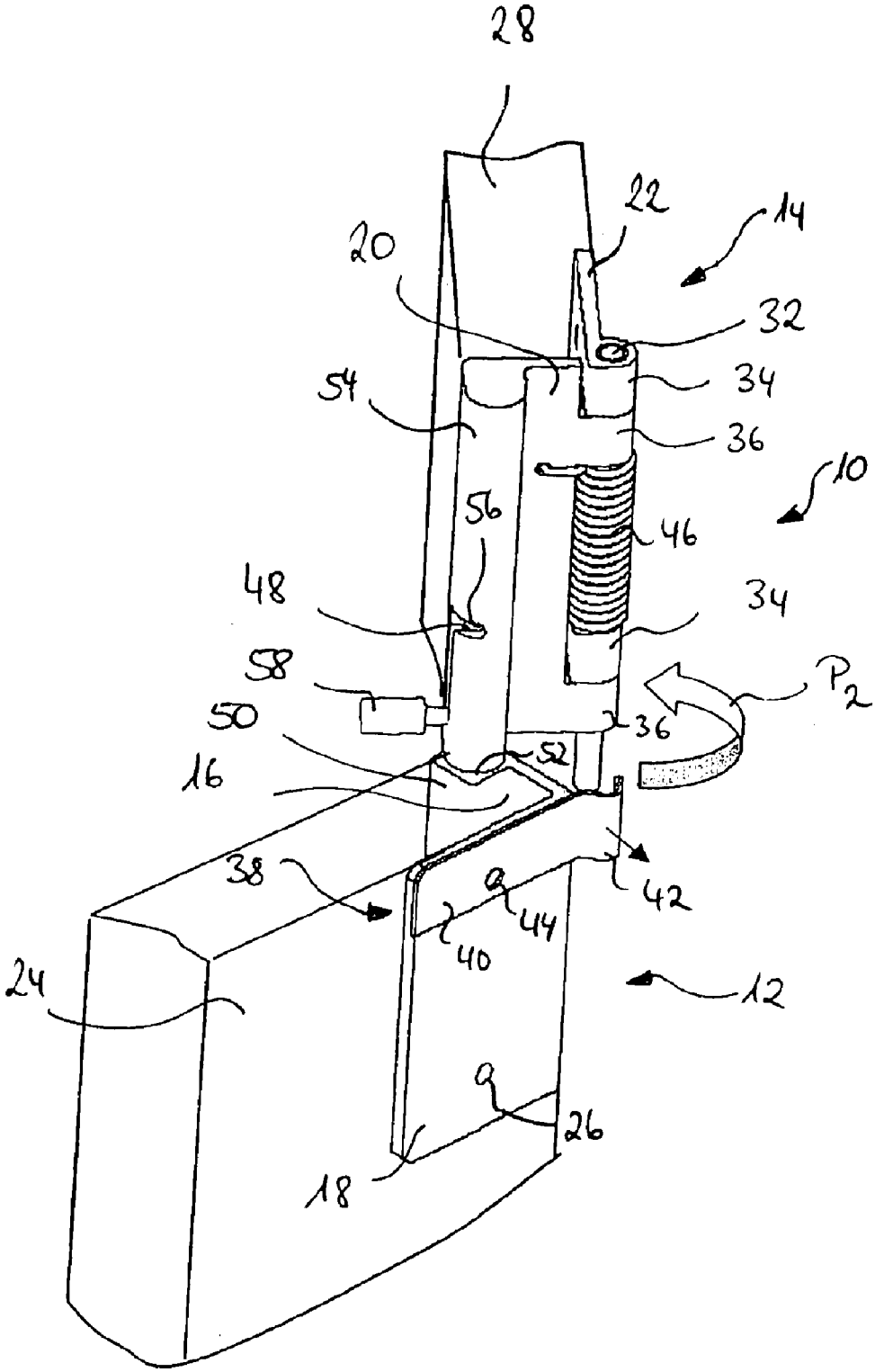
FIGS. 5 & 6 show three-dimensional front views of the door hinge according to FIG. 1, in a second operating condition and in two different opening positions.
Figure 6:
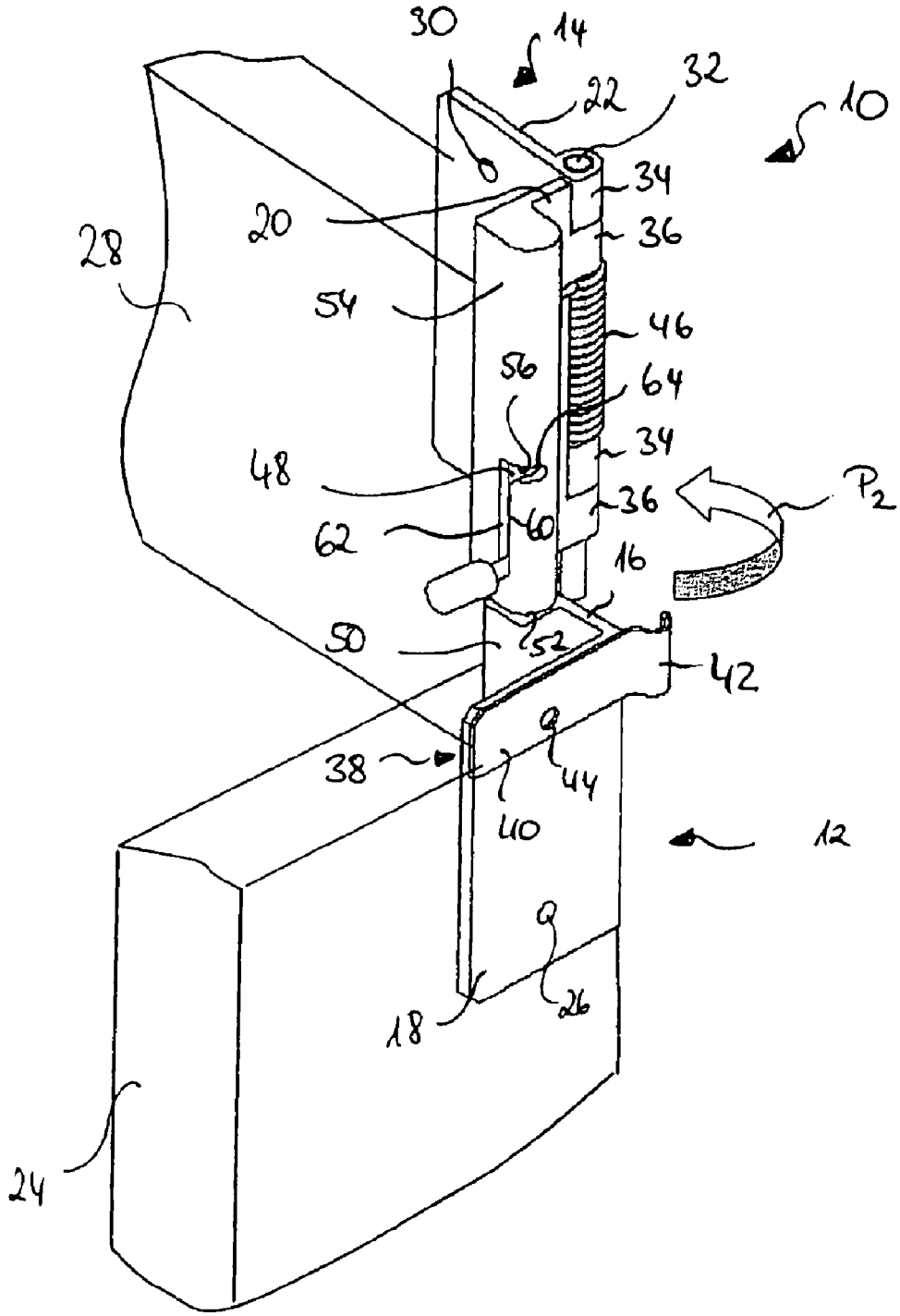

As can be seen, in particular, from FIGS. 3, 5 and 6, the first hinge element 12 is connectable to a door frame 24. When said first hinge element 12 is in the condition in which it is mounted on the door frame 24, the second hinge blade 18 of the first hinge element 12 rests against a front side of the door frame 24, while the first hinge blade 16 of said first hinge element 12 extends along an inner side of said door frame 24. The second hinge blade 18 of the first hinge element 12 is provided with bores 26. For the purpose of fastening the first hinge element 12 to the door frame 24, suitable fastening devices, such as screws or rivets for example, can be passed through the bores 26 constructed in the second hinge blade 18 of said first hinge element 12, and can be fixed to the door frame 24.

The second hinge element 14, on the other hand, can be connected to a door leaf 28. Constructed in the second hinge blade 22 of the second hinge element 14 are bores 30, through which suitable fastening devices, such as screws or rivets for example, can be passed in order to fasten said second hinge blade 22 of the second hinge element 14 to the door leaf 28. A door arrangement which comprises the door frame 24, the door leaf 28 and also the door hinge 10 serves for the purpose of dividing a smoking area from a non-smoking area within an aircraft cabin.

The door hinge 10 also comprises a first pivot axis 32 which is received in two receiving sheaths 34 which are constructed integral with the second hinge blade 22 of the second hinge element 14. Additionally extending from the first hinge blade 20 of the second hinge element 14 are two holding arms 36 which engage round sections of the first pivot axis 32 which are not received in the receiving sheaths 34. The second hinge blade 22 of the second hinge element 14 is thus pivotable, relative to the first hinge blade 20 of the second hinge element 14, about the pivot axis 32.

Figure 7:
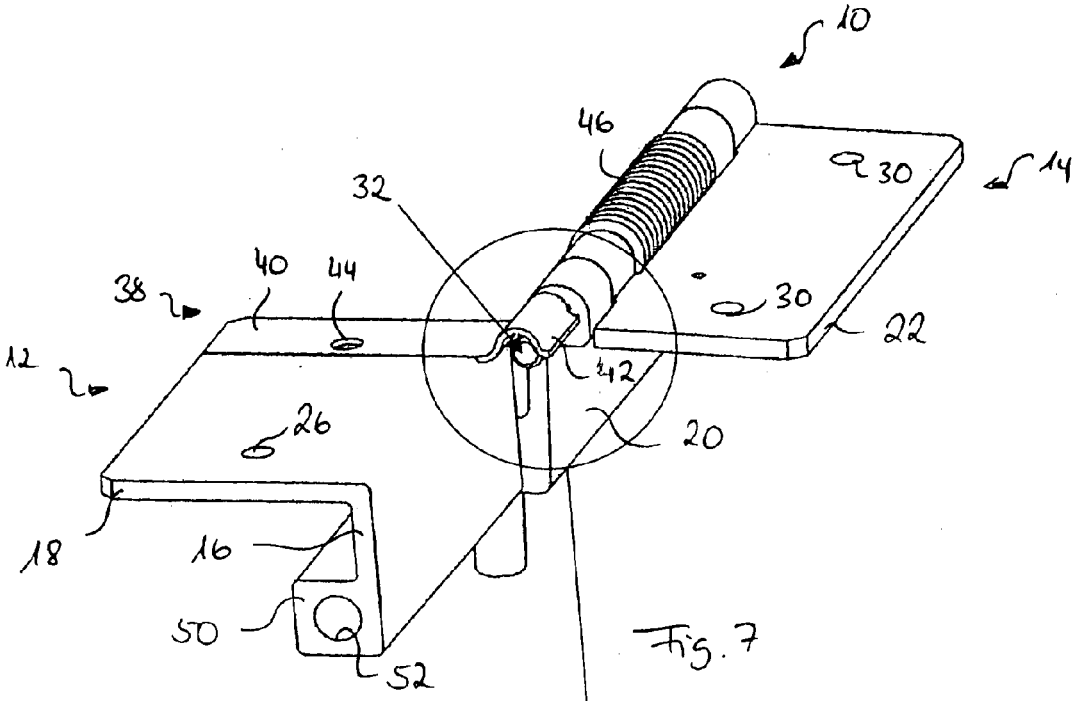
FIG. 7 shows a three-dimensional end view of the door hinge according to FIG. 1.
Figure 8:
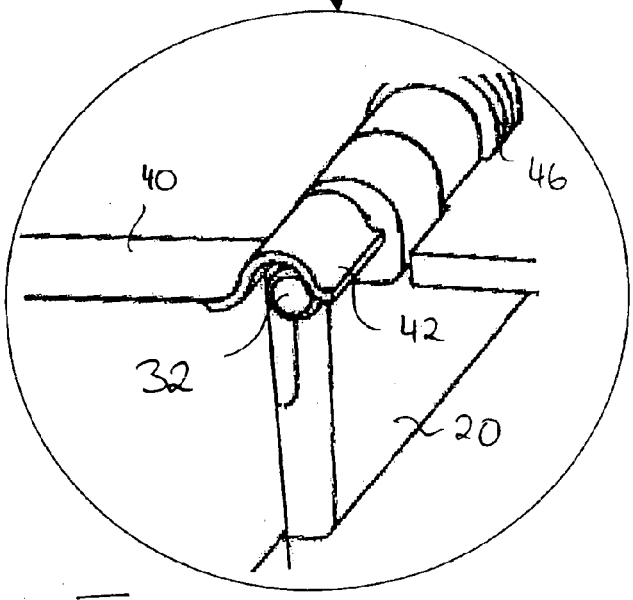
FIG. 8 shows a detail of the door hinge according to FIGS. 7.

As can be seen, in particular, from FIGS. 7 and 8, there is fitted to the first hinge element 12 a connecting device 38 which serves to connect the first pivot axis 32 to said first hinge element 12 in a releasable manner. Said connecting device 38 has a fastening section 40 for fastening a leaf spring 42 to the first hinge element 12. Constructed in the fastening section 40 is a bore 44 which, when the first hinge element 12 is in the condition in which it is mounted on the door frame 24, is in alignment with one of the bores 26 constructed in the second hinge blade 18 of the first hinge element 12, so that a fastening device which is passed through the bores 26, 44 is able to fulfil the double function of fastening the first hinge element 12 to the door frame 24 and, at the same time, fixing the connecting device 38 to said first hinge element 12.

When the door hinge 10 is in a first operating condition (see FIGS. 1 to 4, 7 and 8), the leaf spring 42 engages round a free end of the first pivot axis 32 and thus establishes a connection between said first pivot axis 32 and the first hinge element 12. When the door hinge 10 is in the first operating condition, it is thus possible to pivot the second hinge blade 22 of the second hinge element 14 about the first pivot axis 32, relative to the first hinge blade 20 of the second hinge element 14 and also relative to the first hinge element 12, which is connected rigidly to the door frame 24, in a first pivot direction which is illustrated by an arrow $P_1$ in FIG. 4.

Figure 4:
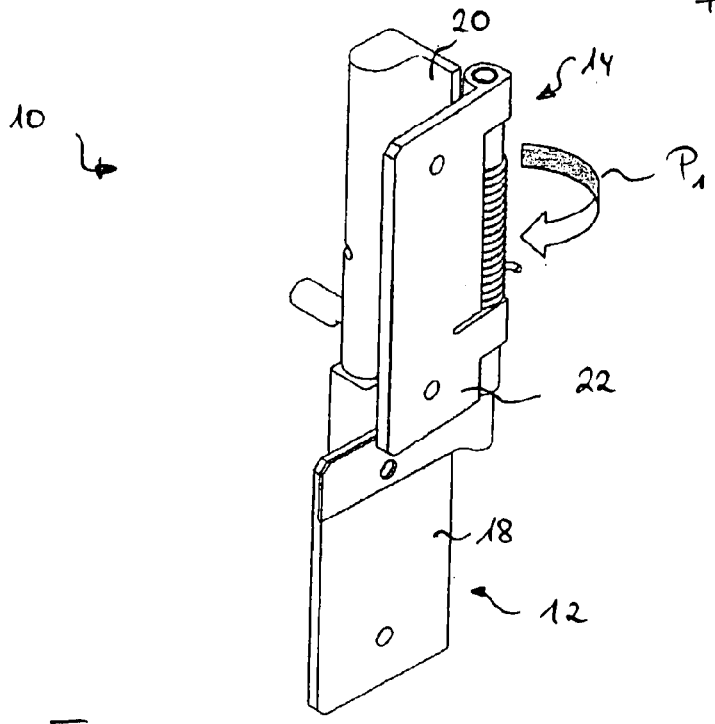
FIG. 4 shows a three-dimensional front view of the door hinge according to FIG. 1 in an open position.

As can likewise be seen, in particular, from FIG. 4, the arrangement of the first pivot axis 32 when the door hinge 10 is in the first operating condition permits pivoting of the second hinge blade 22 of the second hinge element 14 about the first pivot axis 32 by about 180°. This ensures that the door leaf 28 fastened to said second hinge element 14 completely unblocks a door aperture bounded by the door frame 24 when the door hinge 10 is in a completely open position.

Said door hinge 10 also comprises a spring 46 which is constructed in the form of a helical torsion spring and which pretensions the second hinge blade 22 of the second hinge element 14 counter to the first pivot direction, i.e. counter to the pivot direction illustrated by the arrow $P_1$ in FIG. 4. The effect of the force of the torsion spring 46 is that the second hinge blade 18 of the second hinge element 14 automatically moves back out of an open position, which is illustrated in FIGS. 3 and 4 for example, and into a closing position which is shown in FIGS. 1, 2, 7 and 8, as soon as an opening force is no longer applied to said second hinge blade 22 of the second hinge element 14. This ensures that a door leaf 28 which is connected to the second hinge blade 22 of the second hinge element 14 is automatically moved back into a closing position in which it occludes the door aperture bounded by the door frame 24, if said door leaf 28 is not held in its open position by an external force.

Figure 2:
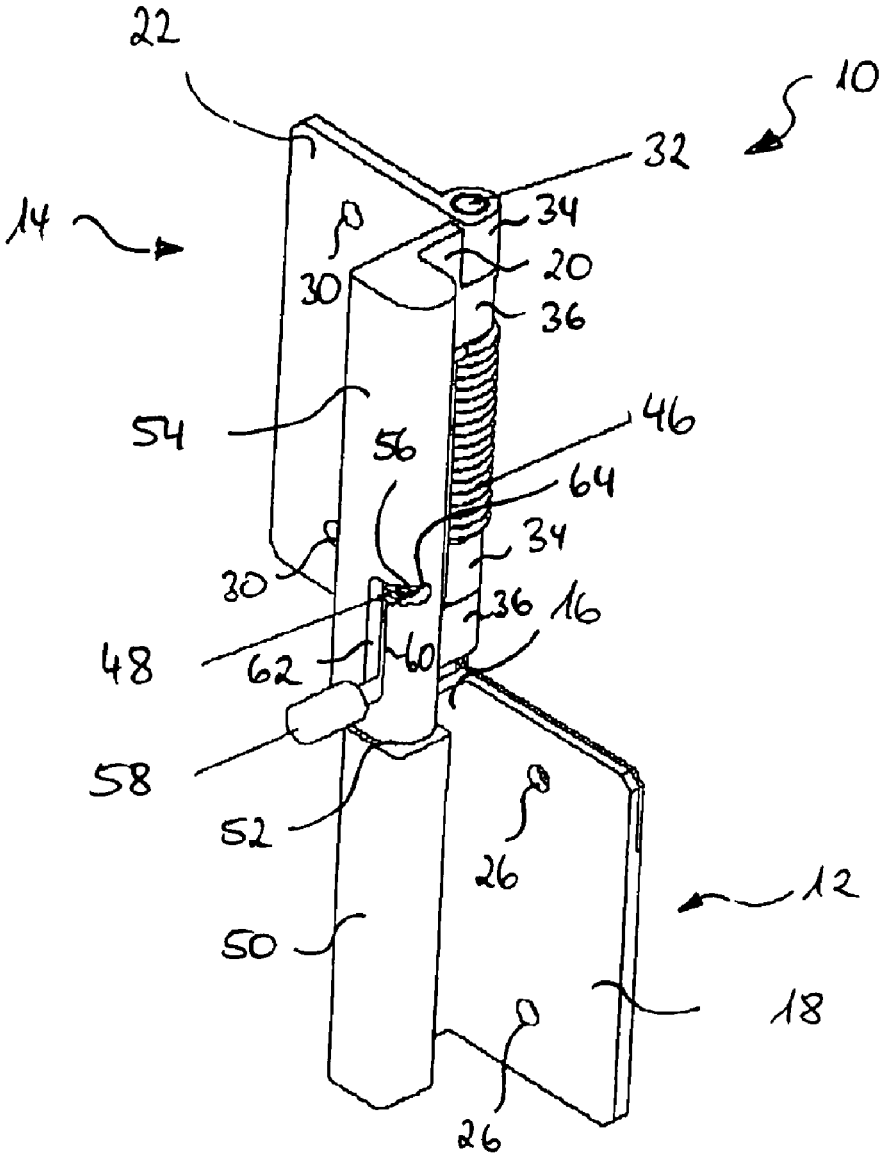
FIG. 2 shows a three-dimensional rear view of the door hinge according to FIG. 1.

As can be seen, in particular, from FIGS. 2 and 6, the door hinge 10 also comprises a second pivot axis 48. For the purpose of connecting said second pivot axis 48 to the first hinge element 12, the first hinge blade 16 of said first hinge element 12 comprises a receiving section 50. Constructed in said receiving section 50 is a receiving apparatus 52, which is constructed in the form of a bore, for receiving the second pivot axis 48.

For the purpose of connecting the second pivot axis 48 to the second hinge element 14, the first hinge blade 20 of the second hinge element 14 also has a receiving section 54. Constructed in said receiving section 54 is a receiving apparatus 56, which is likewise constructed in the form of a bore, for receiving the second pivot axis 48. When the door hinge 10 is in the first operating condition shown in FIGS. 1 to 4, 7 and 8, the second pivot axis 48 merely forms a rigid connecting axis between the first and the second hinge element 12, 14.

The connecting device 38 provided in the first hinge element 12, i.e. in particular the leaf spring 42, is so designed, with respect to its geometry and stiffness, that the connection between said leaf spring 42 and the first pivot axis 32 cannot be released manually, i.e. by pressing or striking against the door leaf 28, but only if a predetermined differential pressure is acting upon the door leaf 28. When designing the connecting device 38 or leaf spring 42, it is possible to use, as the predetermined differential pressure, a differential pressure which builds up on the two mutually opposed main faces of the door leaf 28 in the event of a decompression in the aircraft cabin, which is maintained at elevated pressure during flight, and which differential pressure prevents manual pivoting of the door leaf in the first pivot direction $P_1$. As a result of the connection between the leaf spring 42 and the first pivot axis 32 being released, the door hinge 10 is shifted out of its first operating condition which is shown in FIGS. 1 to 4, 7 and 8, and into a second operating condition which is illustrated in FIGS. 5 and 6.

When the door hinge 10 is in the second operating condition, the second pivot axis 48 permits pivoting of the second hinge element 14, i.e. of the first and second hinge blades 20, 22 of said second hinge element 14, about said second pivot axis 48, relative to the first hinge element 12, in a second pivot direction which is opposed to the first pivot direction $P_1$ and is illustrated by an arrow $P_2$ in FIGS. 5 and 6. As a result of this, it is also possible, when the door hinge 10 is in the second operating condition, for the door leaf 28 to be pivoted in a second pivot direction $P_2$ which is opposed to the first pivot direction $P_1$, in order to unblock the door aperture bounded by the door frame 24. This ensures that the door leaf 28 can be pivoted, for the purpose of unblocking the door aperture bounded by the door frame 24, even if, in the event of a decompression within the aircraft cabin, a differential pressure acting upon the door leaf 28 makes it impossible to pivot said door leaf 28 in the first pivot direction $P_1$.

A spring-loaded unlocking lever 58 is fitted to the second pivot axis 48. Said spring-loaded unlocking lever 58 projects through a guide aperture 60 which is constructed on the second receiving apparatus 56 of the second hinge element 14. Said guide aperture 60 comprises a displacement section 62 and also a stop section 64 which extends substantially perpendicularly to said displacement section 62.

Figure 9:
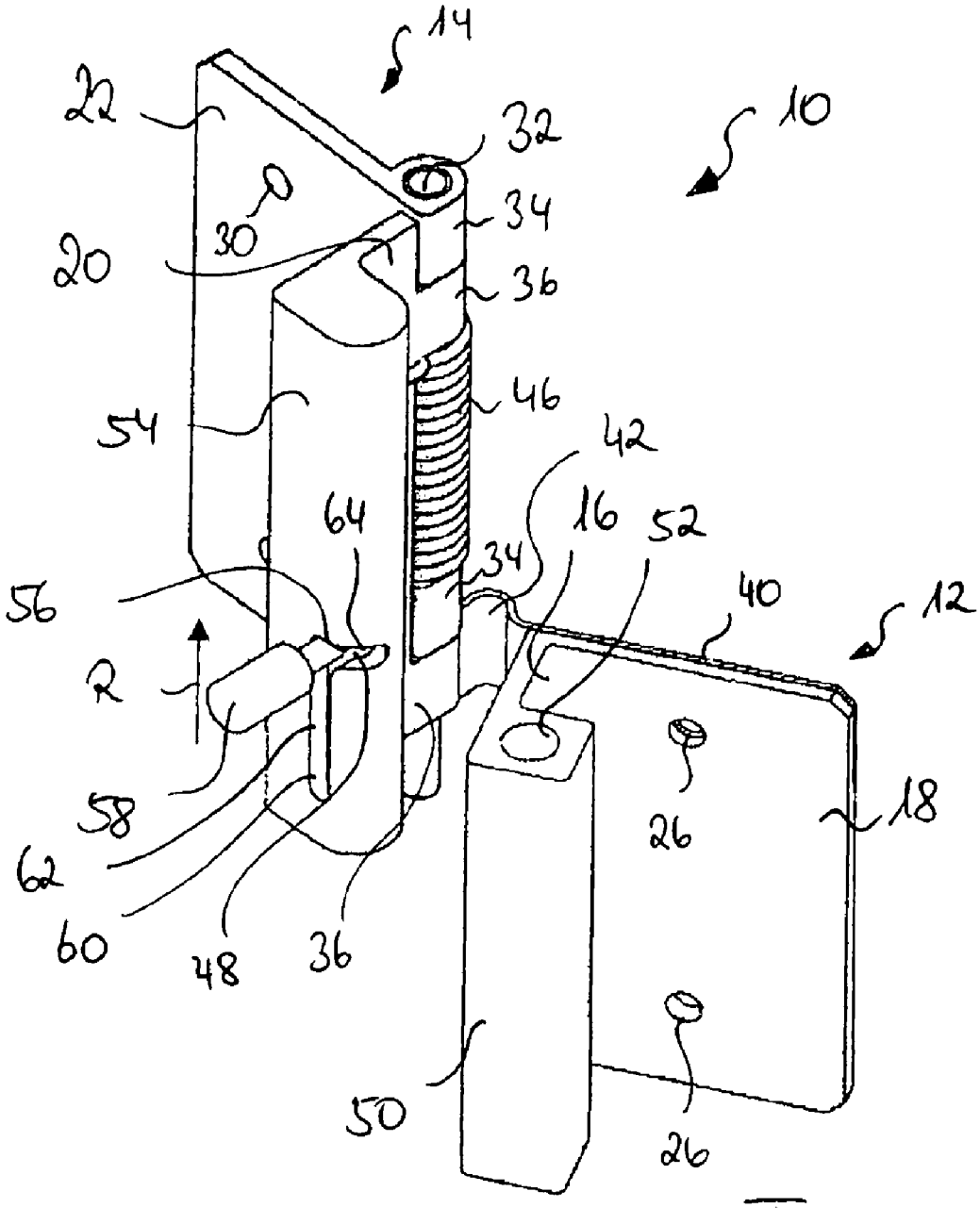
FIG. 9 shows a three-dimensional rear view of the door hinge according to FIG. 1, in a completely unlocked condition.

As a result of displacement of the spring-loaded unlocking lever 58, counter to the spring force, in a direction which is illustrated by an arrow R in FIG. 9, the second pivot axis 48 can be displaced out of its position in the first receiving apparatus 52 of the first hinge element 12, and can thereby be released from said first hinge element 12. For the purpose of fixing the second pivot axis 48 in its releasing position, the spring-loaded unlocking lever 58 can, in addition, be moved into the stop section 64 of the guide aperture 60.

If the connection between the first pivot axis 32 and the first hinge element 12 is also released, complete separation of the first and second hinge elements 12, 14 is possible by means of the spring-loaded unlocking lever 58. The door leaf 28 can thereby be separated from the door frame 24 if necessary, i.e. in an emergency or for maintenance purposes, in a simple and convenient manner.

The invention claimed is:

1. Door hinge having:

a first hinge element which is fastenable to a door frame;

a second hinge element which is fastenable to a door leaf and comprises a first hinge blade and a second hinge blade;

a first pivot axis which is connected to the first hinge element in a releasable manner through use of a connecting device and which is connected to the second hinge element through use of a holding device; and a second pivot axis which is connected to the first and second hinge elements, wherein the connecting device and the holding device are adapted to connect the first pivot axis to the first and second hinge elements, when the door hinge is in a first operating condition, such that the second hinge blade of the second hinge element is pivotable about said first pivot axis, relative to the first hinge element, in a first pivot direction, for the purpose of unblocking a door aperture which is bounded by the door frame, and wherein the connecting device further is adapted to release the connection between the first pivot axis and the first hinge element when the door hinge is in a second operating condition such that, said first and second hinge elements are pivotable about said second pivot axis, relative to one another, in a second pivot direction which is opposed to the first pivot direction, for the purpose of unblocking the door aperture which is bounded by the door frame.

2. Door hinge according to claim 1, characterised in that the first hinge element comprises a first hinge blade and a second hinge blade which extends substantially perpendicularly to said first hinge blade.

3. Door arrangement having:

a hinge element according to claim 2, which further includes the door frame fastened to the first hinge element, and which further includes the door leaf fastened to the second hinge element.

4. An aircraft comprising a door hinge according to claim 2, wherein the door hinge is disposed within the aircraft to permit a door that can be coupled to the door hinge to pivot about at least one of the first pivot axis and the second pivot axis.

5. Door hinge according to claim 1, characterised in that the connecting device comprises a leaf spring

6. Door hinge according to claim 1, characterised in that the connecting device comprises a structure that automatically releases the connection between the first pivot axis (32) and the first hinge element when a predetermined differential pressure acts upon the door leaf which is fastened to the door frame by means of the door hinge.

7. Door hinge according to claim 1, characterised in that a first receiving apparatus for connecting the second pivot axis to the first hinge element is provided on said first hinge element.

8. Door hinge according to claim 7, characterised in that a second receiving apparatus for connecting the second pivot axis to the second hinge element is provided on said second hinge element.

9. Door hinge according to claim 8, characterised in that the second receiving apparatus provided on the second hinge element has a guide aperture for guiding the a spring-loaded unlocking lever kW-provided on the second pivot axis, when said spring-loaded unlocking lever is actuated.

10. Door hinge according to claim 9, characterised in that the guide aperture has a displacement section and a stop section which extends substantially perpendicularly to said displacement section.

11. An aircraft comprising a door hinge according to claim 10, wherein the door hinge is coupled with a structure of the aircraft to permit or deny passage of an object without movement of a door when the door is coupled to the door hinge.

12. Door arrangement having:

a hinge element according to claim 10, which further includes the door frame fastened to the first hinge element, and which further includes the door leaf fastened to the second hinge element.

13. Door hinge according to claim 1, characterized in that a holding device for connecting the first pivot axis to the second hinge element is provided on said second hinge element.

14. Door hinge according to claim 1, characterised in that the second hinge blade of the second hinge element is pretensioned, counter to the first pivot direction, by means of a spring positioned between the first hinge blade and the second hinge blade such that an orientation of the first hinge blade and the second hinge blade relative to a neutral point of the spring provides the pretension.

15. Door hinge according to claim 1, characterised in that a spring-loaded unlocking lever for releasing the second pivot axis from the first or the second hinge element is provided on the said second pivot axis.

16. Door hinge according to claim 15, characterised in that a receiving apparatus provided on the second hinge element has a guide aperture for guiding the spring-loaded unlocking lever provided on the second pivot axis, when said spring-loaded unlocking lever is actuated.

17. Door arrangement having:

a hinge element according to claim 1 which further includes the door frame fastened to the first hinge element, and which further includes the door leaf fastened to the second hinge element.

18. An aircraft that includes a door arrangement according to claim 17, wherein the door arrangement is used to close and open a throughway of the aircraft.

19. An aircraft that includes a door hinge according to claim 1, wherein the door hinge is disposed internal to the aircraft to permit a door to block and unblock a passageway.

* * * * *